US009447656B2

(12) United States Patent
Robb et al.

(10) Patent No.: US 9,447,656 B2
(45) Date of Patent: Sep. 20, 2016

(54) BOP HEATING METHODS AND SYSTEMS AND HEAT EXCHANGE UNITS

(71) Applicant: Baker Hughes Incorporated, Houston, TX (US)

(72) Inventors: Sam Robb, Red Deer (CA); Jim Colquhoun, Langdon (CA)

(73) Assignee: Baker Hughes Incorporated, Houston, TX (US)

( * ) Notice: Subject to any disclaimer, the term of this patent is extended or adjusted under 35 U.S.C. 154(b) by 352 days.

(21) Appl. No.: 14/169,068

(22) Filed: Jan. 30, 2014

(65) Prior Publication Data

US 2014/0144612 A1 May 29, 2014

Related U.S. Application Data

(63) Continuation of application No. 13/183,330, filed on Jul. 14, 2011, now Pat. No. 8,726,998.

(51) Int. Cl.

| | |
|---|---|
| ***E21B 36/00*** | (2006.01) |
| ***E21B 33/037*** | (2006.01) |
| ***F28F 3/12*** | (2006.01) |

(52) U.S. Cl.

CPC ..... *E21B 36/006* (2013.01); *E21B 33/037* (2013.01); *E21B 36/00* (2013.01); *F28F 3/12* (2013.01)

(58) Field of Classification Search

CPC ..... E21B 36/006; F28F 3/12

See application file for complete search history.

(56) References Cited

U.S. PATENT DOCUMENTS

| | | | | |
|---|---|---|---|---|
| 2,404,736 | A | 7/1946 | Marick | |
| 2,482,665 | A | 9/1949 | Geyer | |
| 3,079,486 | A | 2/1963 | Winchell | |
| 5,049,724 | A | 9/1991 | Anderson | |
| 5,306,897 | A * | 4/1994 | Fraser | B23P 6/002 165/46 |
| 5,960,876 | A | 10/1999 | Wiedemann | |
| 6,032,732 | A | 3/2000 | Yewell | |
| 6,776,227 | B2 | 8/2004 | Beida et al. | |
| 7,207,389 | B2 | 4/2007 | Foster et al. | |
| 8,037,936 | B2 * | 10/2011 | Neuroth | E21B 36/04 166/302 |
| 8,267,195 | B1 | 9/2012 | Scruggs | |
| 2003/0168518 | A1 * | 9/2003 | Beida | E21B 36/005 237/80 |
| 2005/0061512 | A1 | 3/2005 | Reid | |

OTHER PUBLICATIONS

Schlumberger Oilfield Glossary entry for "kill line", accessed Mar. 11, 2016 via www.glossary.oilfield.slb.com.*

(Continued)

*Primary Examiner* — Blake Michener

(74) *Attorney, Agent, or Firm* — Parsons Behle & Latimer

(57) ABSTRACT

A BOP heating method includes operating a coiled tubing unit (CTU) using hydraulic fluid. The fluid is supplied from the CTU to an exchange tube and returned from the exchange tube to the CTU. The method includes transmitting heat from the fluid to an inner plate. Heat is transmitted from the inner plate to a BOP on which the inner plate is temporarily mounted. A BOP heating system includes a CTU configured to use hydraulic fluid, a supply tube configured to supply fluid from the CTU to an exchange tube, and a return tube configured to return fluid from the exchange tube to the CTU. A BOP heat exchange unit includes an outer plate and an inner plate, an exchange tube between the outer plate and the inner plate, and a heat spreading material between the exchange tube and the inner plate. The exchange unit lacks any electrical component.

19 Claims, 6 Drawing Sheets

(56) References Cited

OTHER PUBLICATIONS

C. P. Kothandaraman & S. Subramanyan, Heat and Mass Transfer Data Book 1-14 (New Age International Ltd, 6th ed. 2008).
Enform, "BOP Heater Blanked Electrical Short Resulting in a Fire", Mar. 31, 2011, pp. 1-2, Safety Alert Issue #Jul. 2011.
International Preliminary Examining Authority; IPRP for International Application No. PCT/US12/39263 dated Aug. 1, 2013.
US Patent and Trademark Office; Office Action for U.S. Appl. No. 13/183,330 dated Jul. 31, 2013.
International Search Report and Written Opinion dated Mar. 14, 2013 issued in PCT/US2012/039263.

* cited by examiner

BOP HEATING METHODS AND SYSTEMS AND HEAT EXCHANGE UNITS

RELATED APPLICATIONS

This application is a continuation of U.S. patent application Ser. No. 13/183,330, filed Jul. 14, 2011, and entitled "BOP Heating Methods and Systems and Heat Exchange Units," which is incorporated herein by reference in its entirety.

BACKGROUND

1. Field of the Disclosure

The embodiments described herein relate generally to blowout preventer (BOP) heating methods, BOP heating systems, and BOP heat exchange units.

2. Description of the Related Art

Fossil fuel (petroleum, natural gas, etc.) production occurs in a wide variety of climates, including climates in which ambient temperature drops below freezing during at least part of a day and, perhaps, throughout an entire day. Some production equipment has been designed to remain operational in cold climates, however, other production equipment, such as BOPs, may experience reduced functionality during low or below freezing ambient temperatures.

One known device for heating a BOP is described in U.S. Pat. No. 5,049,724 issued to Anderson and includes a thermal blanket fitted with an electrical heating element. By energizing the heating element, radiant heat may be applied to a BOP and heat loss reduced using the thermal blanket.

However, electrical BOP heater blankets have been known to create safety hazards, for example, due to electrical shorts. In some jurisdictions, electrical BOP heater blankets must be certified safe when installed and periodically subjected to electrical inspection. Also, electrical heater blankets, such as shown in U.S. Pat. No. 5,049,724, must be removed for maintenance on equipment over which the blanket is installed.

In addition to electrical elements creating a spark hazard, the temperatures at which electrical elements operate in order to provide adequate radiant heat may be high enough to create a burn hazard for equipment or personnel. Electrical elements further use extra electricity, increasing operational cost.

Although electrical BOP heater blankets may provide heat sufficient to maintain BOP functionality, the potential hazards, maintenance inconvenience, and operational costs make them a less than desirable solution. Accordingly, further advancement in methods and apparatuses for heating BOPs may be of benefit.

SUMMARY

A BOP heating method includes operating a coiled tubing unit using a hydraulic fluid in a hydraulically manipulated component, the hydraulic fluid increasing in temperature with use and exceeding an ambient temperature. The hydraulic fluid is supplied from the coiled tubing unit through a supply tube to an exchange tube and returned from the exchange tube through a return tube to the coiled tubing unit. The method includes transmitting heat from the hydraulic fluid through a wall of the exchange tube and through a heat spreading material to an inner plate. The heat spreading material is between the exchange tube and the inner plate. The exchange tube is arranged in a serpentine form between the inner plate and an opposing outer plate. Heat is transmitted from the inner plate to a BOP on which the outer plate, the exchange tube, the heat spreading material, and the inner plate are temporarily mounted, a control opening through the outer plate, the inner plate, and the heat spreading material exposing a control port of the BOP. The method increases a temperature of the BOP to above ambient temperature using the heat from the hydraulic fluid.

A BOP heating system includes an outer plate and an opposing inner plate, an exchange tube arranged in a serpentine form between the outer plate and the inner plate, and a heat spreading material between the exchange tube and the inner plate. A control opening through the outer plate, the inner plate, and the heat spreading material is configured to expose a control port of a BOP. The system includes a coiled tubing unit configured to use hydraulic fluid, a supply tube configured to supply hydraulic fluid from the coiled tubing unit to the exchange tube, and a return tube configured to return hydraulic fluid from the exchange tube to the coiled tubing unit.

A BOP heat exchange unit includes an outer plate and an opposing inner plate, an exchange tube arranged in a serpentine form between the outer plate and the inner plate, and a heat spreading material between the exchange tube and the inner plate. A control opening through the outer plate, the inner plate, and the heat spreading material is configured to expose a control port of a BOP. The outer plate, the exchange tube, the heat spreading material, and the inner plate are fastened together to form the exchange unit. The exchange unit lacks any electrical component.

Figure 1:
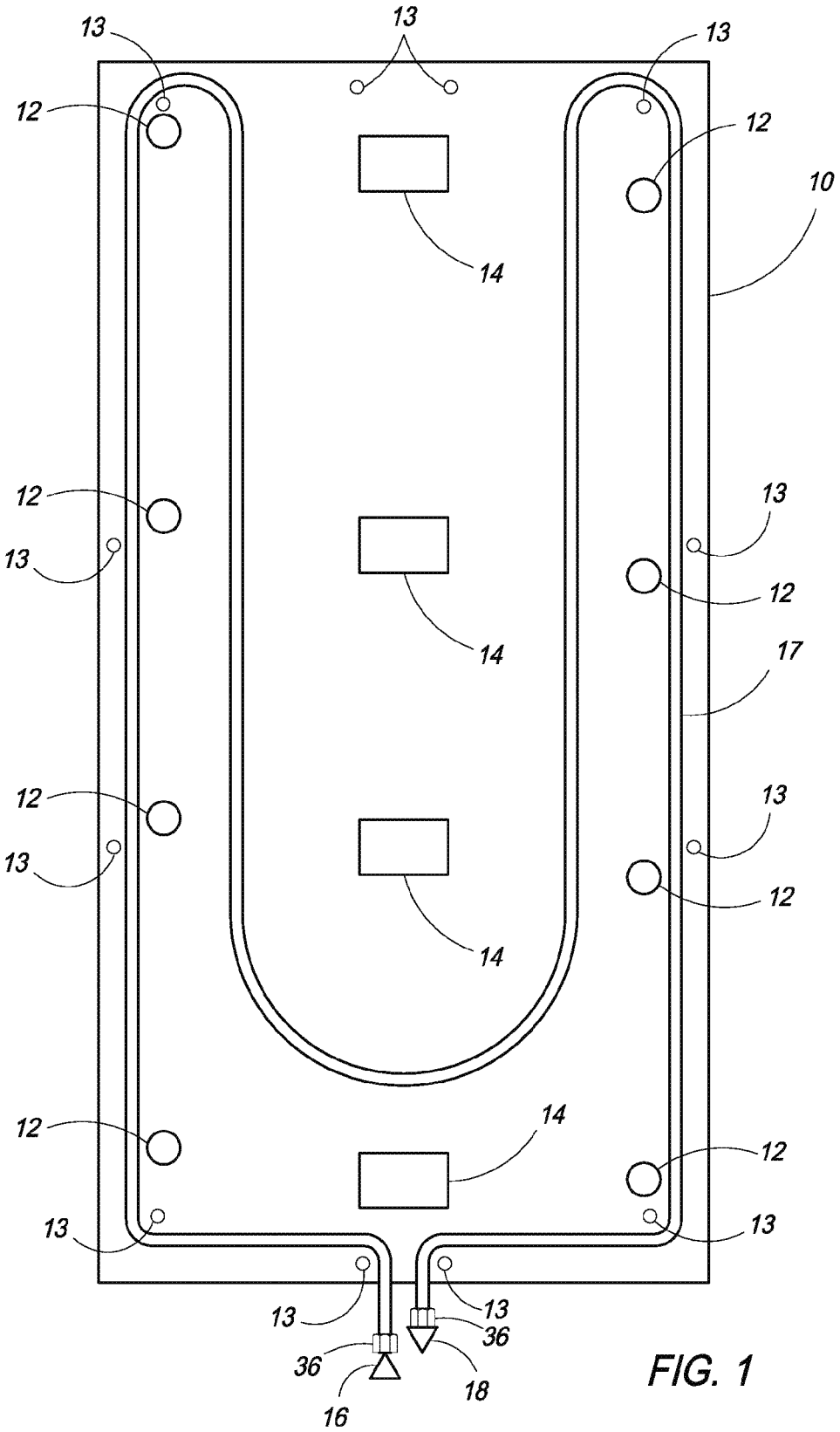
FIG. 1 is a view of selected components of a heat exchange unit.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

A coiled tubing unit is a known, frequently used apparatus often stationed at a production well site during the phase in which a BOP is installed over a wellbore. A coiled tubing unit may include a reel of tubing used to shuttle equipment up and down a well bore and to inject process fluids as the reel winds and unwinds the tubing. Operation of a coiled tubing unit often includes use of a hydraulic fluid in hydraulically manipulated components. Examples of hydraulically manipulated components often found in a coiled tubing unit include a coiled tubing reel, a coiled tubing injector, a BOP accumulator system and recharge pump, and a hydraulic driven electrical generator.

Even when ambient temperatures are below freezing, the hydraulic fluid in a coiled tubing unit may increase sufficiently in temperature with use to exceed the ambient temperature. Temperature of the hydraulic fluid may approach 130° F., for example, it may reach 120° F. Although the hydraulic fluid temperature may be low enough that it is unlikely to create a burn hazard for equipment or personnel, it is conceivable to use heat from the hydraulic fluid to warm production equipment, such as a BOP, to above ambient temperature.

Figure 7:
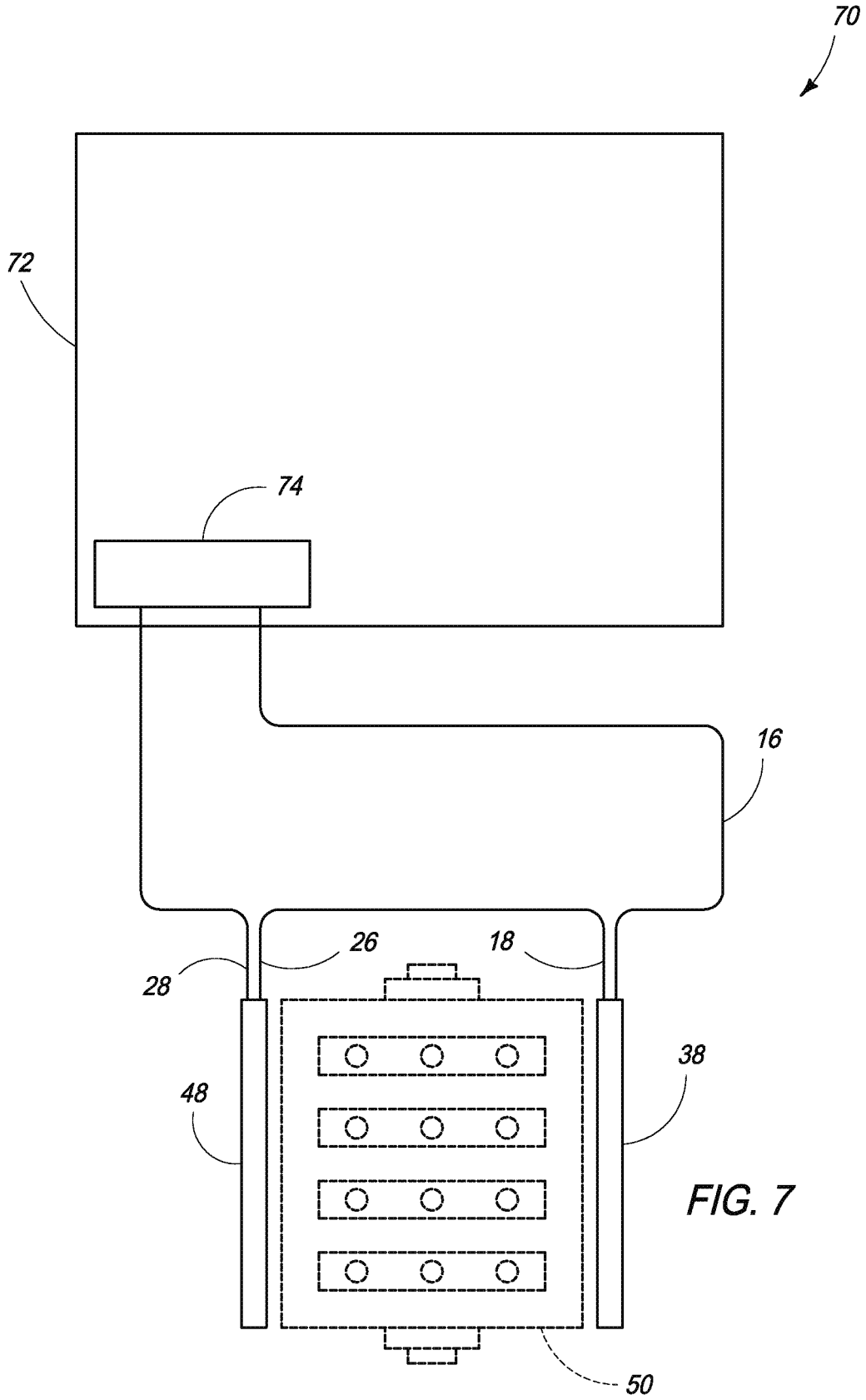
FIG. 7 is a schematic view of a BOP heating system including the BOP and heat exchange units of FIGS. 3-6.

FIG. 7 shows a BOP heating system 70 that includes a coiled tubing unit 72 having a hydraulic system 74. A supply tube 16 provides heated hydraulic fluid to exchange unit 38. Return tube 18 returns cooled hydraulic fluid from exchange unit 38. Exchange unit 38 and exchange unit 48 are shown connected in series. Thus, return tube 18 from exchange unit 38 may be the same as supply tube 26 to exchange unit 48. Return tube 28 returns additionally cooled hydraulic fluid from exchange unit 48 to hydraulic unit 74. Accordingly, hydraulic fluid may circulate between hydraulic system 74 and exchange units 38 and 48. A BOP 50 is shown in FIG. 7 as an optional component since it is conceivable that heating system 70 could be used to provide heat even in the absence of BOP 50 while coiled tubing unit 72 is present.

Figure 5:
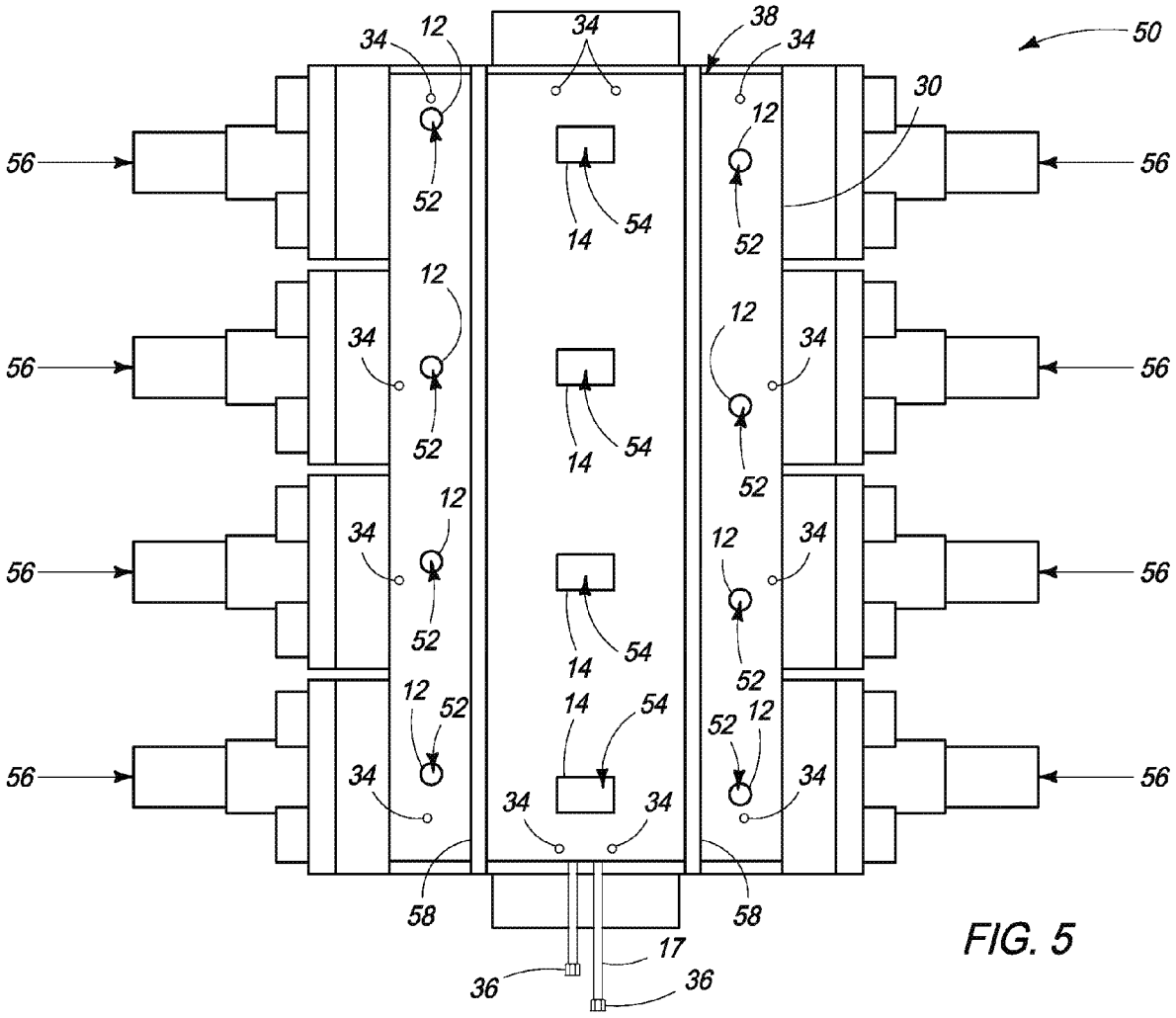
FIG. 5 is a front view of a BOP with the heat exchange unit of FIG. 3 removably mounted thereon.
Figure 6:
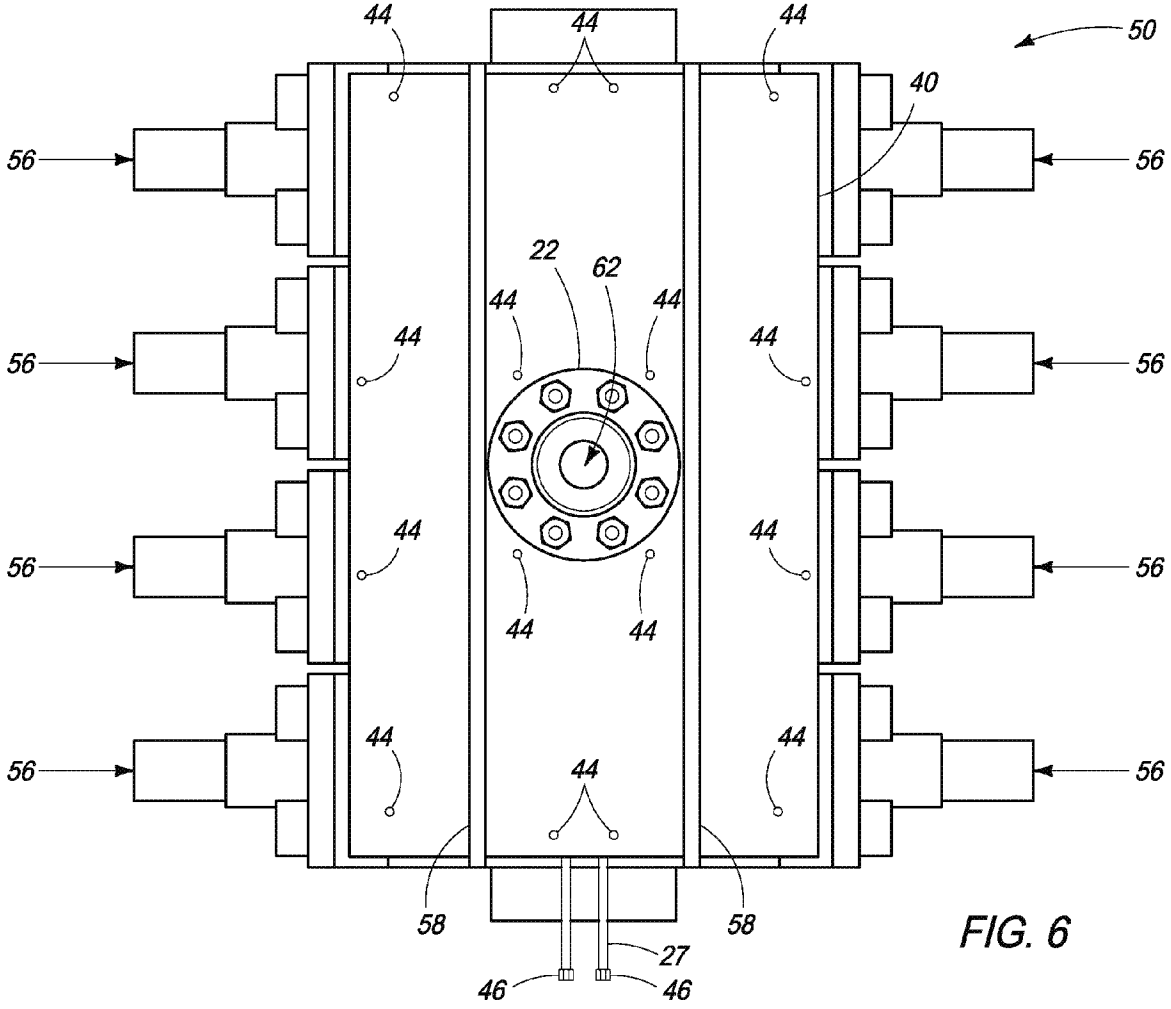
FIG. 6 is a rear view of the BOP in FIG. 5 with the heat exchange unit of FIG. 4 removably mounted thereon.

FIGS. 5 and 6 show respective front side and rear side views of BOP 50 with exchange unit 38 mounted on BOP 50 in the front side view of FIG. 5 and exchange unit 48 mounted on BOP 50 in the rear side view of FIG. 6. In FIG. 5, BOP 50 is shown to include multiple actuator ports 52 and equalizer ports 54. In FIG. 6, BOP 50 is shown to include a kill port 62. Any known BOP may be used for BOP 50 and may include any known configuration for actuator ports, equalizer ports, kill ports, or other control ports. As will be appreciated, the embodiments described herein may be adapted to a variety of types and configurations for control ports on the front side or rear side of a BOP.

BOP 50 in FIGS. 5-7 is shown to include four rams 56. Rams 56 may be, for example, pipe rams, blind rams, shear rams, blind shear rams, or combinations thereof. Rams 56 may be of any known type and configuration and may be fewer or greater in number than shown. While the large, flat front side and rear side of BOP 50 is especially conducive to providing a surface area whereon exchange units 38 and 48 may be mounted to heat BOP 50, a BOP with differently shaped sides or having a larger or smaller surface area may also be conducive to implementing the embodiments herein. Exchange units may exhibit a shape configured to transmit heat to a BOP mostly through conduction, as opposed to radiation or convection.

Accordingly, exchange units may exhibit a size and a shape configured to substantially cover one side of an outer shell of a BOP, such as shown for the front side and rear side of BOP 50 in FIGS. 5 and 6. Indeed, while the Figures show a ram type of BOP, the embodiments may also be implemented for other types of BOPs. In FIG. 5, a width of exchange unit 38 matches a width of the front side of BOP 50 and a height of exchange unit 38 is substantially the same as a height of the front side. Only a narrow strip of the front side of BOP 50 is not covered at the top and bottom of the front side. Accordingly, the front side is substantially covered.

In FIG. 6, a width of exchange unit 48 is slightly greater than a width of the rear side of BOP 50 so that exchange unit 48 overlaps rams 56. A height of exchange unit 48 is substantially the same as a height of the rear side. Only a narrow strip of the rear side of BOP 50 is not covered at the top and bottom of the rear side. Accordingly, the rear side is substantially covered. To the extent that the portion of exchange unit 48 overlapping rams 56 does not contact BOP 50, it may still transmit heat through radiation and/or convection, but not conduction. Also, instead of providing the overlap shown, the widths of both exchange units 38 and 48 may be the same, at least substantially matching the width of the respective front side and rear side.

A band 58 shown in FIGS. 5 and 6 secures exchange unit 38 and exchange unit 48 in place on BOP 50. Band 58 may temporarily mount exchange units 38 and 48 on BOP 50 and enable heat transmission mostly through conduction to BOP 50. Even so, it will be appreciated from the description herein that exchange units 38 and 48 may be easily dismounted upon the removal of band 58. Disconnecting control lines (not shown), if any, from actuator ports 52, equalizer ports 54, and kill port 62 may allow complete removal and storage of exchange units 38 and 48 during warmer weather seasons when heating is not used. Remounting of exchange units 38 and 48 may occur with similar ease followed by pressure testing merely to confirm no leaks exist. Certification is not needed, in contrast to the electrical inspection often required for installation of electric BOP heater blankets.

Exchange unit 38 is shown to include actuator openings 12 and equalizer openings 14 through which respective actuator ports 52 and equalizer ports 54 are exposed for use. Similarly, exchange unit 48 is shown to include kill port opening 22 through which kill port 62 is exposed and extends outward beyond exchange unit 48.

Fasteners 34 and fasteners 44 are apparent from FIGS. 5 and 6 and fasten together the components of respective exchange unit 38 and exchange unit 48. Exchange tube 17 extends from exchange unit 38 and exchange tube 27 extends from exchange unit 48. Exchange tube 17 and exchange tube 27 respectively include tube unions 36 and tube unions 46 used to join exchange tube 17 and exchange tube 27 to supply tubes and return tubes (not shown).

Accordingly, in an embodiment, a BOP heating method includes operating a coiled tubing unit by using a hydraulic fluid in a hydraulically manipulated component, the hydraulic fluid increasing in temperature with use and exceeding an ambient temperature. The hydraulic fluid is supplied from the coiled tubing unit through a supply tube to an exchange tube and returned from the exchange tube through a return tube to the coiled tubing unit. The method includes transmitting heat from the hydraulic fluid through a wall of the exchange tube and through a heat spreading material to an inner plate. The heat spreading material is between the exchange tube and the inner plate. The exchange tube is arranged in a serpentine form between the inner plate and an opposing outer plate. Heat is transmitted from the inner plate to a BOP on which the outer plate, the exchange tube, the heat spreading material, and the inner plate are removably mounted. A control opening through the outer plate, the inner plate, and the heat spreading material exposes a control port of the BOP. The method includes increasing a temperature of the BOP to above ambient temperature using the heat from the hydraulic fluid.

By way of example, the BOP may include as control ports a kill port and an actuator port. The control opening may expose the kill port or the actuator port. The hydraulic fluid in the supply tube may exhibit a temperature of less than 130° F. The outer plate, the exchange tube, the heat spreading material, and the inner plate may be fastened together to form an exchange unit. Given the potential safety concerns with electrical elements in BOP heater blankets, the exchange unit may be designed not to include any electrical component.

The exchange unit may be removably mounted on one side of a BOP. An additional exchange unit including an additional outer plate, an additional exchange tube, an additional heat spreading material, and an additional inner plate may be fastened together and removably mounted on another side of the BOP. The coiled tubing unit may supply the hydraulic fluid both to the exchange unit and to the additional exchange unit. The one side of the BOP may oppose the other side of the BOP. Also, the exchange unit and the additional exchange unit may be configured to remain installed on the BOP during maintenance of the BOP.

Instead of relying on radiant heat, as with known BOP heater blankets, or convective heat transfer, the transmission of heat from the inner plate to the BOP may occur mostly through conduction. A variety of installing configurations and exchange unit designs in keeping with the embodiments described herein may be relied on to facilitate conductive heat transfer to the BOP.

In an embodiment, a BOP heat exchange unit includes an outer plate and an opposing inner plate, an exchange tube arranged in a serpentine form between the outer plate and the inner plate, and a heat spreading material between the exchange tube and the inner plate. A control opening through the outer plate, the inner plate, and the heat spreading material is configured to expose a control port of a BOP. The outer plate, the exchange tube, the heat spreading material, and the inner plate are fastened together to form the exchange unit and the exchange unit lacks any electrical component.

By way of example, the heat spreading material may also be between the outer plate and the exchange tube. The exchange tube may have a surface area and the inner plate may have an exterior surface exhibiting an area that is greater than one-half of the surface area of the exchange tube that exists between the outer plate and the inner plate. The inner plate, the exchange tube, and the heat spreading material may each have a thermal conductivity at 68° F. of at least 7 British thermal units/hour-° Fahrenheit-feet (BTU/(hr-° F.-ft) (12 watts/meter-Kelvin (W/(m-K)). In other words, the components are thermally conductive, as opposed to being thermally insulative. In this manner, the combination of the exchange tube, the heat spreading material, and inner plate provides a greater surface area for conductive heat transfer than maximally available with the exchange tube alone.

Known methods exist for warming process equipment with the use of heat-tracing loops. Heat tape with electrical heating elements therein or tubing carrying steam may be wound around process equipment and insulated to facilitate heating. Tape or tubing used in a heat-tracing loop exhibits a surface area of which at most half contacts the process equipment, depending on cross-sectional shape of the tape or tubing. For tubing with a round cross-section, a small portion of the tubing actually contacts the process equipment. Insulating the tracing facilitates heat transfer by radiation and/or convection to supplement the comparably small amount of conductive heat transfer.

Often, use of heat-tracing loops involves the labor-intensive practice of unwinding tracing from process equipment for maintenance. The insulation and/or tracing may cover connections, valves, ports, and other components to be accessed during the maintenance. Heat tape, with its electrical heating elements, would generally need recertification after reinstallation following maintenance. With the known use of steam at 212° F. or higher as the heated fluid in tubing for heat-tracing loops, the risk of equipment or personnel burns is significant. Further, both heat tape and steam tubing use additional energy, increasing operational cost. The listed disadvantages of known heat-tracing may be contrasted with benefits of the embodiments described herein.

With the heat spreading material of the embodiments herein between the exchange tubing and the inner plate, an exchange unit may increase the effective surface area available for conductive heat transfer to a BOP. The heat spreading material also between the outer plate and the exchange tube may further increase the effective surface area. The serpentine form of the exchange tube between the outer plate and the inner plate also increases the available surface area for a heated fluid in the exchange tube to transmit heat to the inner plate.

Heat transfer between the exchange tube and the inner plate could be subject to the same limitations of heat-tracing. However, the heat spreading material may contact most or substantially all of the surface area of the exchange tube and increase conductive heat transfer to the inner plate. The increased efficiency of heat transfer by conduction and the increase in heat transfer given an increased surface area of the inner plate allows effective use of heated fluids at a lower temperature than steam. As indicated, a lower temperature, for example, less than 130° F., may reduce burn hazards for equipment or personnel.

Accordingly, embodiments of the BOP heat exchange unit described herein may exhibit a size and shape configured to substantially cover one side of an outer shell of a BOP. The heat exchange unit may exhibit a shape configured to transmit heat from the inner plate to a BOP mostly through conduction, wherein the heat spreading material includes metal wool. Stainless steel, aluminum, and copper wool exhibit a sufficient thermal conductivity to function as the heat spreading material. Other known thermally conductive materials capable of conforming to contact most or substantially all of the exchange tubing and most or substantially all of an interior surface of the inner plate may suffice instead. Also, stainless steel, aluminum, copper, etc. plates may exhibit suitable thermal conductivity, structural strength, and ductility to function as the inner plate. Further, Stainless steel, aluminum, copper, etc. tubing may exhibit suitable thermal conductivity and pressure rating to function as the exchange tube. Corrosion and the possibility of metallurgical reaction present additional considerations in material selection for the indicated components.

Figure 3:
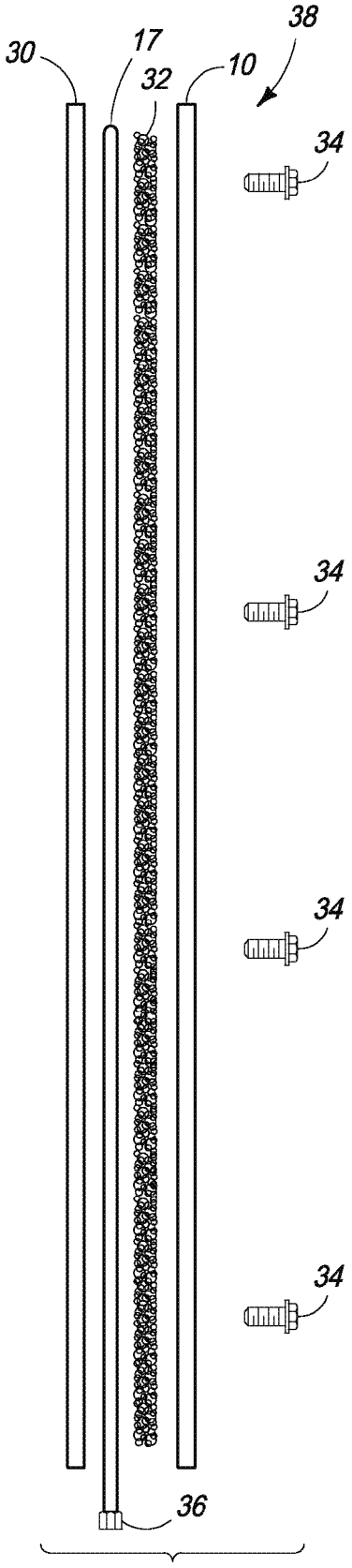
FIG. 3 is a side view of a heat exchange unit including the selected components of FIG. 1.

FIG. 1 shows selected components of exchange unit 38, which is shown as a complete unit in a side view of FIG. 3. An inner plate 10 includes actuator openings 12 and equalizer openings 14, allowing access to actuator ports and equalizer ports of a BOP. Inner plate 10 also includes fastener openings 13 through which fasteners 34 may be inserted to fasten together inner plate 10 and an outer plate 30 with exchange tube 17 and metal wool 32 therebetween. Although machine screws are shown for fasteners 34, a variety of fasteners including screws, bolts, rivets, etc. sufficient to keep the components in thermally conductive contact and maintain structural integrity of the exchange unit may be suitable.

Exchange tube 17 is shown in a serpentine form to increase contact area for heat transfer. Tube unions 36 at the two ends of exchange tube 17 allow for removable connection to supply tube 16 and return tube 18, which are represented in FIG. 1 by arrowheads indicating direction of flow for the hydraulic fluid.

Figure 2:
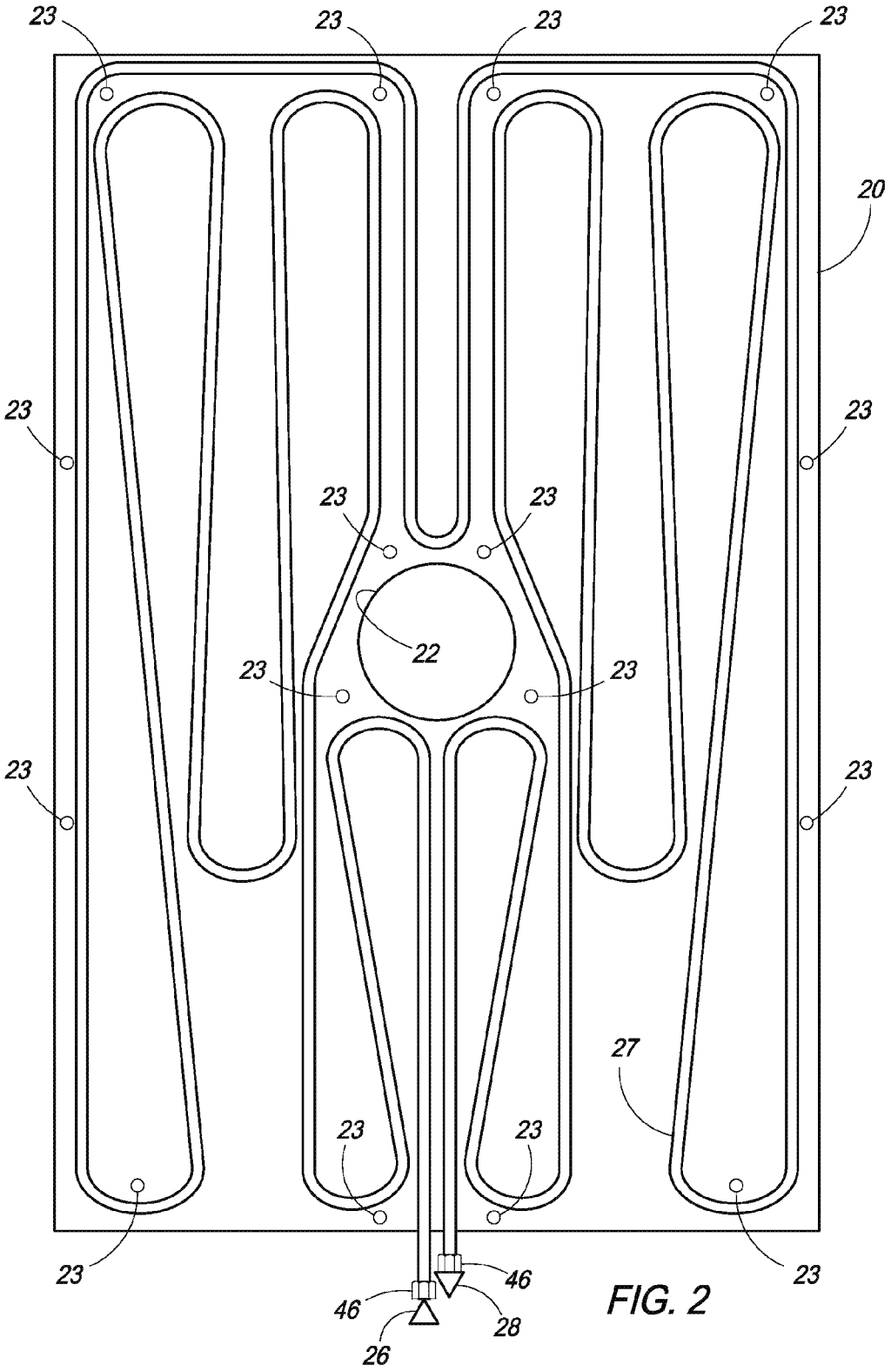
FIG. 2 is a view of selected components of another heat exchange unit.
Figure 4:
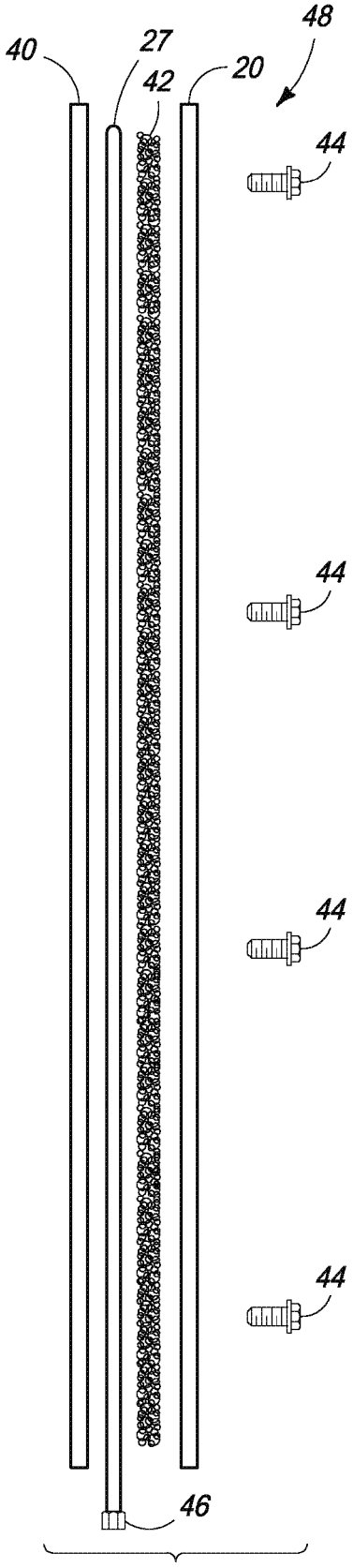
FIG. 4 is a side view of another heat exchange unit including the selected components of FIG. 2.

FIG. 2 shows selected components of exchange unit 48, which is shown as a complete unit in a side view of FIG. 4. An inner plate 20 includes kill port opening 22, allowing access to a kill port of a BOP. Inner plate 20 also includes fastener openings 23 through which fasteners 44 may be inserted to fasten together inner plate 20 and an outer plate 40 with exchange tube 27 and metal wool 42 therebetween. Fasteners 44 may be selected from among those listed above for fasteners 34.

Exchange tube 27 is shown in a serpentine form to increase contact area for heat transfer. Tube unions 46 at the two ends of exchange tube 27 allow for removable connection to supply tube 26 and return tube 28, which are represented in FIG. 2 by arrowheads indicating direction of flow for the hydraulic fluid.

Notably, the presence of only one control opening (kill port opening 22) or the absence of the additional control openings of FIG. 1 allows a longer exchange tube. Given the increased length of exchange tube 27 in comparison to exchange tube 17, increased heat transfer is provided. Differences between the serpentine form of exchange tube 17 and exchange tube 27 demonstrate the variability of suitable forms. Accordingly, space constraints dictated by physical dimensions of the inner and/or outer plate along with avoiding obstruction of control openings may influence selection of a particular serpentine form. Manufacturing considerations influenced by material properties, such as avoidance of crimping when bending tubing, may also influence the form selected.

According to an embodiment, a BOP heating system includes an outer plate and an opposing inner plate, an exchange tube arranged in a serpentine form between the outer plate and the inner plate, and a heat spreading material between the exchange tube and the inner plate. A control opening through the outer plate, the inner plate, and the heat spreading material is configured to expose a control port of a BOP. The BOP heating system includes a coiled tubing unit configured to use hydraulic fluid. A supply tube is configured to supply hydraulic fluid from the coiled tubing unit to the exchange tube and a return tube is configured to return hydraulic fluid from the exchange tube to the coiled tubing unit.

By way of example, the heat spreading material may also be between the outer plate and the exchange tube. The outer plate, the exchange tube, the heat spreading material, and the inner plate may be fastened together to form an exchange unit. The inner plate, the exchange tube, and the heat spreading material may each have a thermal conductivity at 68° F. of at least 7 BTU/hr-° F.-ft) (12 W/m-K). Other features of the exchange unit may be as described elsewhere in the present document.

The system may further include a BOP. The inner plate of the exchange unit may have an exterior surface exhibiting an area. Most of the area of the exterior surface of the inner plate may directly contact the BOP. In the Example below, only about 30% of the exterior surface of the exchange units directly contacted the BOP due to recesses in part of the front side and the rear side of the BOP and the flat exterior surface of the exchange units. However, other known BOPs with flat sides allow as much as 100% direct contact even for an exchange unit having a flat exterior surface. The outer plate, the exchange tube, the heat spreading material, and the inner plate may be removably mounted on the BOP and configured to remain installed on the BOP during maintenance of the BOP.

EXAMPLE

Exchange units, or heat pads, similar to those shown in FIGS. 1-4 were built using ¼ inch aluminum sheets for the inner and outer plates, ½ inch stainless steel tubing for the exchange tube, and stainless steel wool for the heat spreading material. The stainless steel wool was additionally placed between the outer plate and the exchange tube. The serpentine forms for the stainless steel tubing followed the general pattern of FIGS. 1 and 2, but were not exactly as shown. The serpentine form used in one heat pad had a few more bends with short runs and was, consequently, slightly longer than shown in FIG. 1. The serpentine form used in another heat pad had a few less bends and was, consequently, somewhat shorter than shown in FIG. 2. However, on a whole, similar results could be expected using the serpentine forms shown in FIGS. 1 and 2.

The aluminum sheets, stainless steel tubing, and stainless steel wool were fastened together in the configuration shown in FIGS. 1 (or 3) and 2 (or 4) using 5/16 inch tapered head cap screws as fasteners. The resulting heat pads were then mounted on a Model P407QBXO-4-1/16" 15 Ksi quad BOP assembly manufactured by Forum Energy Technologies of Leduc, Alberta, Canada as shown in FIGS. 5 and 6 in direct contact with the BOP. Roughly, 30% of the exterior surface of the inner plate in FIG. 1 (or 3) contacted the BOP. Roughly, 30% of the exterior surface of the inner plate in FIG. 2 (or 4) contacted the BOP. Process equipment that was disconnected from actuator ports and the kill port to allow mounting was reconnected. Ratchet tie downs with nylon straps were used as the bands to secure the heat pads to the BOP. The stainless steel tubing of the heat pads was fluidically connected via ⅜ inch single braid hydraulic hose to the auxiliary hydraulic system of a coiled tubing unit and supplied with hydraulic oil at a temperature of about 120° F. Hydraulic oil flow through the stainless steel tubing was maintained by the auxiliary system hydraulic pump.

At the start of a first test using only the FIG. 6 exchange unit as the heat pad, the ambient and BOP temperatures were −15° C. After two hours of circulating hydraulic oil through the heat pad, BOP temperature reached 0° C. At the start of a second test using both heat pads connected in series, the ambient and BOP temperatures were −9° C. After only one hour of circulating hydraulic oil through both heat pads, BOP temperature reached 4° C. As a result, it was determined that coiled tubing unit hydraulic oil at an intrinsically safe temperature is capable of heating a BOP to temperatures above freezing.

Although various embodiments have been shown and described, the present disclosure is not so limited and will be understood to include all such modifications and variations as would be apparent to one skilled in the art.

TABLE OF REFERENCE NUMERALS FOR FIGS. 1-7

| |
|---|
| 10 inner plate |
| 12 actuator opening |
| 13 fastener opening |
| 14 equalizer opening |
| 16 supply tube |
| 17 exchange tube |
| 18 return tube |
| 20 inner plate |

-continued

| TABLE OF REFERENCE NUMERALS FOR FIGS. 1-7 |
|---|
| 22 kill port opening |
| 23 fastener opening |
| 26 supply tube |
| 27 exchange tube |
| 28 return tube |
| 30 outer plate |
| 32 metal wool |
| 34 fastener |
| 36 tube union |
| 38 exchange unit |
| 40 outer plate |
| 42 metal wool |
| 44 fastener |
| 46 tube union |
| 48 exchange unit |
| 50 blowout preventer |
| 52 actuator port |
| 54 equalizer port |
| 56 rams |
| 58 band |
| 62 kill port |
| 70 BOP heating system |
| 72 coiled tubing unit |
| 74 hydraulic system |

What is claimed is:

1. A system having a blowout preventer (BOP) heat exchange unit comprising:

an outer plate, an opposing inner plate, and a gap between the outer plate and the inner plate, the inner plate having a thermal conductivity at 68° F. of at least 7 BTU/(hr-° F.-ft) (12 W/(m-K));

a hollow exchange tube separate from the outer plate and the inner plate and arranged in a serpentine form in the gap between the outer plate and the inner plate;

a heat spreading material in the gap between the exchange tube and the inner plate;

a control opening through the outer plate, the inner plate, and the heat spreading material, the control opening being configured to expose a BOP control port;

the outer plate, the exchange tube, the heat spreading material, and the inner plate being fastened together to form the exchange unit separate from a BOP; and the exchange unit lacking any electrical component.

2. The system of claim 1 wherein the exchange tube has a surface area and the inner plate has an exterior surface configured to contact a surface of a BOP, the exterior surface of the inner plate exhibiting an area that is greater than one-half of the surface area of the exchange tube that exists between the outer plate and the inner plate and wherein the exchange tube and the heat spreading material each have a thermal conductivity at 68° F. of at least 7 BTU/(hr-° F.-ft) (12 W/(m-K)).

3. The system of claim 1 exhibiting a size and shape configured to substantially cover one side of a BOP outer shell.

4. The system of claim 1 having the heat spreading material also between the outer plate and the exchange tube and exhibiting a shape configured to transmit heat from the inner plate to a BOP mostly through conduction, wherein the heat spreading material comprises metal wool.

5. The system of claim 1 further comprising a BOP, the BOP control port comprising a plurality of control ports including a kill port and an actuator port, wherein the outer plate, the exchange tube, the heat spreading material, and the inner plate are mounted on the BOP and wherein the control opening exposes the kill port or the actuator port.

6. The system of claim 1 further comprising a BOP, wherein the inner plate of the exchange unit has an exterior surface exhibiting an area and wherein most of the area of the exterior surface of the inner plate directly contacts the BOP.

7. The system of claim 1 further comprising a BOP and an additional exchange unit including an additional outer plate, an additional exchange tube, an additional heat spreading material, and an additional inner plate fastened together, wherein the exchange unit is removably mounted on one side the BOP and the additional exchange unit is removably mounted on another side of the BOP.

8. The system of claim 7 wherein the one side of the BOP opposes the other side of the BOP and wherein the exchange unit and the additional exchange unit are configured to remain installed on the BOP during maintenance of the BOP.

9. The system of claim 1, wherein the outer plate and opposing inner plate are a pair of substantially rigid metallic plates.

10. The system of claim 1, wherein the inner plate is a metallic plate.

11. A system having a blowout preventer (BOP) heat exchange unit comprising:

a rigid outer plate having an interior surface, a rigid opposing inner plate having an interior surface facing the interior surface of the outer plate, and a gap between the interior surface of the outer plate and the interior surface of the inner plate;

a hollow exchange tube separate from the outer plate and the inner plate and arranged in a serpentine form in the gap;

a heat spreading material between the exchange tube and the interior surface of the inner plate;

a control opening through the outer plate, the inner plate, and the heat spreading material, the control opening being sized and shaped to expose a BOP control port;

the outer plate, the exchange tube, the heat spreading material, and the inner plate being fastened together to form the exchange unit separate from a BOP.

12. The system of claim 11 wherein the exchange tube has a surface area and the inner plate has an exterior surface configured to contact a surface of a BOP, the exterior surface of the inner plate exhibiting an area that is greater than one-half of the surface area of the exchange tube that exists between the outer plate and the inner plate and wherein the inner plate, the exchange tube, and the heat spreading material each have a thermal conductivity at 68° F. of at least 7 BTU/(hr-° F.-ft) (12 W/(m-K)).

13. The system of claim 11 exhibiting a size and shape configured to substantially cover one side of a BOP outer shell.

14. The system of claim 11 having the heat spreading material also between the outer plate and the exchange tube and exhibiting a shape configured to transmit heat from the inner plate to a BOP mostly through conduction, wherein the heat spreading material comprises metal wool.

15. The system of claim 11 further comprising a BOP, the BOP control port comprising a plurality of control ports including a kill port and an actuator port, wherein the outer plate, the exchange tube, the heat spreading material, and the inner plate are mounted on the BOP and wherein the control opening exposes the kill port or the actuator port.

16. The system of claim 11 further comprising a BOP, wherein the inner plate of the exchange unit has an exterior surface exhibiting an area and wherein most of the area of the exterior surface of the inner plate directly contacts the BOP.

17. The system of claim 11 wherein the exchange unit does not include any electrical component.

18. The system of claim 11 further comprising a BOP and an additional exchange unit including an additional outer plate, an additional exchange tube, an additional heat spreading material, and an additional inner plate fastened together, wherein the exchange unit is removably mounted on one side the BOP and the additional exchange unit is removably mounted on another side of the BOP.

19. The system of claim 18 wherein the one side of the BOP opposes the other side of the BOP and wherein the exchange unit and the additional exchange unit are configured to remain installed on the BOP during maintenance of the BOP.

* * * * *